United States Patent [19]

Dusanek

[11] 4,301,332

[45] Nov. 17, 1981

[54] WOOFER LOUDSPEAKER

[76] Inventor: Norman Dusanek, 8116 Deering Ave., Canoga Park, Calif. 91304

[21] Appl. No.: 110,532

[22] Filed: Jan. 8, 1980

[51] Int. Cl.[3] ..... H04R 1/28

[52] U.S. Cl. ..... 179/1 E; 179/146 E; 181/144; 181/163

[58] Field of Search ..... 179/1 E, 115.5 PS, 116, 179/146 E; 181/144, 145, 147, 155, 156, 163

[56] References Cited

U.S. PATENT DOCUMENTS

| | | | |
|---|---|---|---|
| 1,988,250 | 1/1935 | Olson | 181/147 |
| 3,772,466 | 11/1973 | Hossbach | 181/163 |
| 4,039,044 | 8/1977 | Heil | 181/144 |
| 4,076,097 | 2/1978 | Clarke | 181/156 |
| 4,119,799 | 10/1978 | Merlino | 181/144 |
| 4,146,111 | 3/1979 | Mae et al. | 181/155 |
| 4,176,253 | 11/1979 | Gabr | 179/1 E |
| 4,206,830 | 6/1980 | Sohma et al. | 181/163 |

FOREIGN PATENT DOCUMENTS

| | | | |
|---|---|---|---|
| 2552591 | 11/1975 | Fed. Rep. of Germany | 179/1 E |
| 42-31963 | 5/1967 | Japan | 179/1 E |

*Primary Examiner*—Gerald L. Brigance
*Attorney, Agent, or Firm*—Roger A. Marrs

[57] ABSTRACT

A loudspeaker enclosure is disclosed herein having a hollow box provided with a pair of air chambers separated by a partition or baffle. Coaxial openings are incorporated into the two outer walls of the box and the inner partition. An inner and an outer passive speaker cone is disposed in each opening associated with the inner partition and one of the box walls respectively in a back-to-back relationship. A rigid coupling connects the passive cones together so as to operate as a single unit. A woofer speaker cone is mounted in the other box wall which is operated by a suitable amplifier network. The mounting of the speakers creates sealed, air tight chambers and the outer passive cone is larger in diameter than the inner passive cone so that at very low frequencies the outer passive cone displaces more air than the woofer speaker cone.

12 Claims, 8 Drawing Figures

FIG. 1
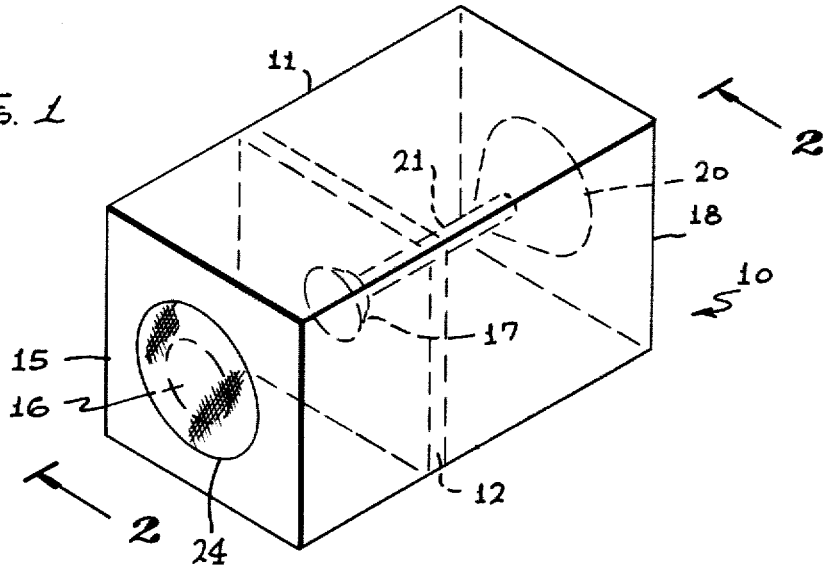
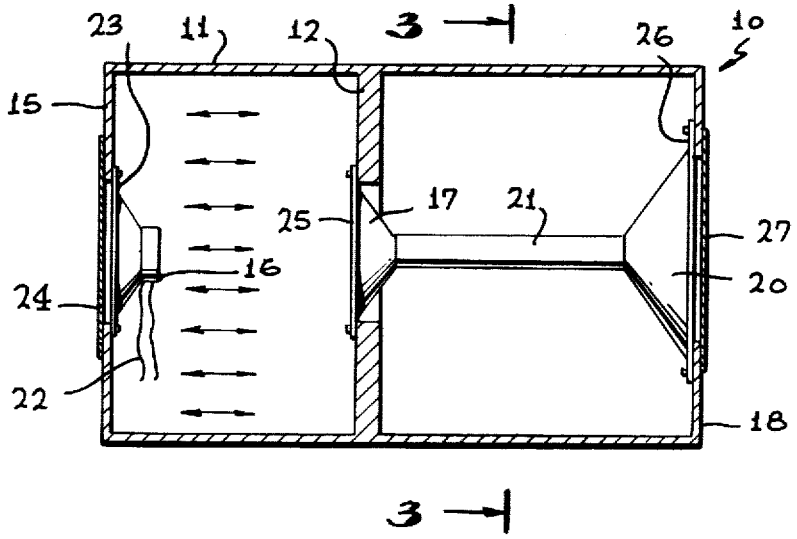
FIG. 2
FIG. 3
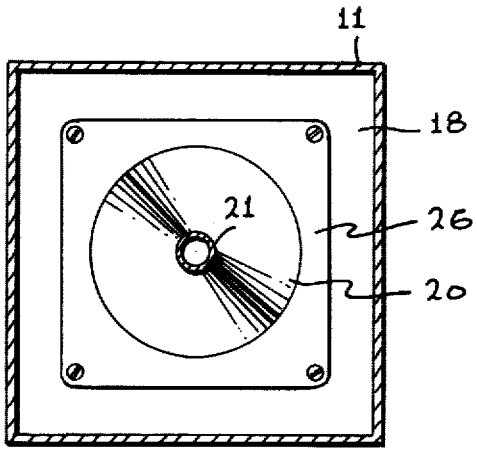
FIG. 4
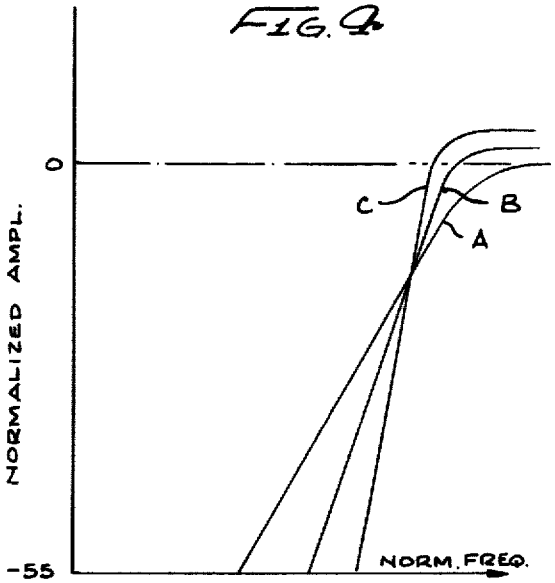

FIG. 5
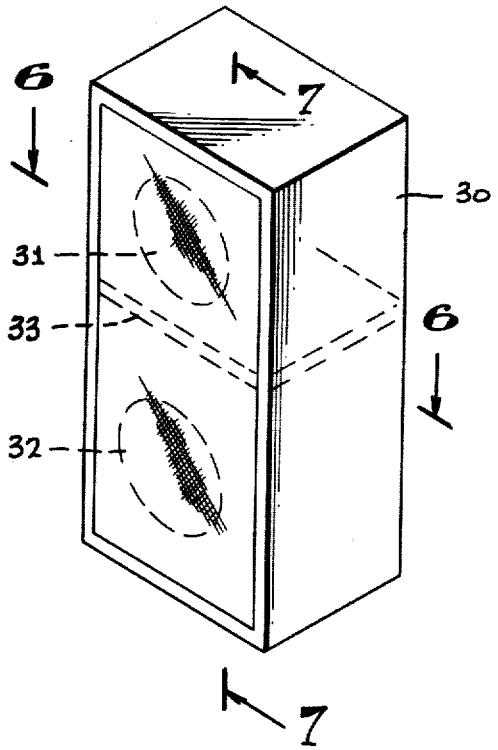
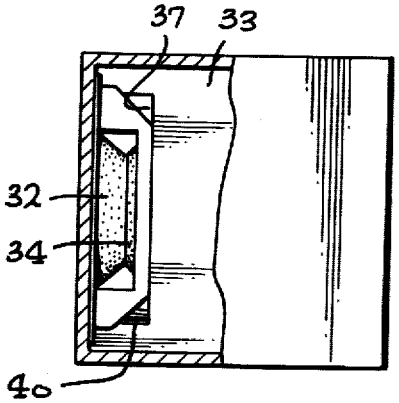
FIG. 6
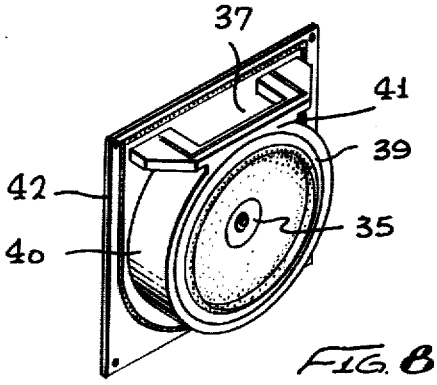
FIG. 8
FIG. 7
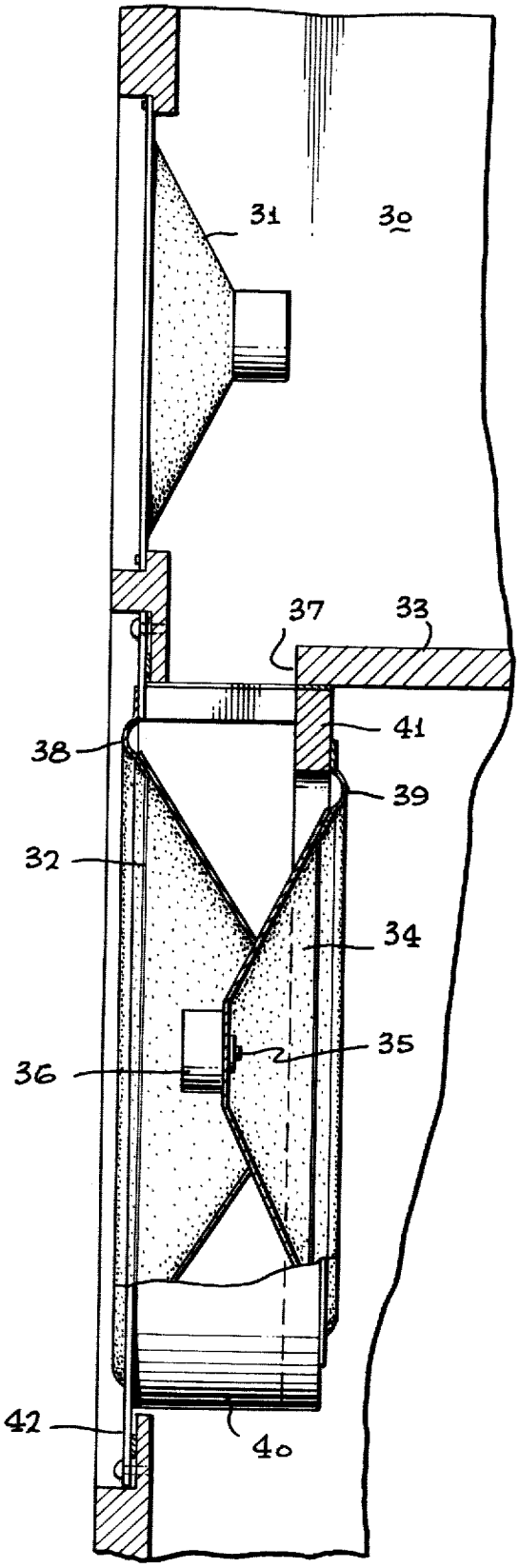

WOOFER LOUDSPEAKER

BACKGROUND OF THE INVENTION

1. Field of the Invention

The present invention relates to a loudspeaker enclosure of the woofer type having improved characteristics capable of reproducing lower frequencies and a much sharper cutoff of frequencies below the operating band width than can be normally obtained employing conventional loudspeaker enclosures.

2. Brief Description of Prior Art

In the past, loudspeaker enclosures have been provided which incorporate an aperture for mounting a speaker cone which propagates sound waves at very low frequencies. Normally, such speakers are known as woofer loudspeakers and are characterized as relatively large boxes having the inability to cut off sharply at frequencies below the operating band width. Consequently, there has been a quest for providing a woofer loudspeaker having a relatively small enclosure which will provide a lower frequency response and yet maintain efficiency so that the loudspeaker system is able to combine lower frequency response, high efficiency and improved dynamic characteristics in a relatively small box. Some attempts have been made to provide a smaller box having these characteristics by employing ported boxes or employing a closed box. However, these attempts have proven to be inefficient since sharper frequency cutoff below operating band width is not available.

Therefore, a longstanding need has existed to provide a woofer loudspeaker having a maximum flat response as well as high efficiency in reproducing lower frequencies in a relatively small enclosure.

SUMMARY OF THE INVENTION

Accordingly, the above problems and difficulties are obviated by the present invention which provides a novel loudspeaker system incorporating an enclosure of box-like construction having a pair of sealed air chambers separated by a partition or baffle situated internally of the box construction. The inner partition and one wall of the box-like construction associated with one chamber operably mount an inner and an outer passive speaker cone respectively which operate in unison in response to a woofer speaker cone mounted on the wall of the box-like construction associated with the other air chamber. Rigid coupling means are carried between the inner passive cone and the outer passive cone so that the cones operate together in response to air movement in the smaller air chamber developed in response to movement of the woofer speaker cone.

A feature of the invention resides in the fact that the two passive cones are of different diameter or size so that at very low frequencies, the outer passive cone displaces more air than the woofer speaker cone.

Therefore, it is among the primary objects of the present invention to provide a novel loudspeaker system of the woofer type having improved low frequency response characteristics provided in a physically smaller box than can otherwise be obtained employing boxes or enclosures of prior art design.

Still another object of the present invention is to provide a novel woofer loudspeaker system having a combination of lower frequency response and higher efficiency from a physically small enclosure than can be otherwise accomplished.

Still a further object of the present invention is to provide a novel woofer loudspeaker system having a pair of different size cones coupled together so as to respond in unison to movement of an active woofer speaker cone.

Yet another object of the present invention is to provide a novel woofer loudspeaker enclosure having a pair of sealed air chambers in which air is moved in one chamber by an active woofer speaker which then operates a pair of passive speaker cones by means of a differential air coupler.

BRIEF DESCRIPTION OF THE DRAWINGS

The features of the present invention which are believed to be novel are set forth with particularity in the appended claims. The present invention, both as to its organization and manner of operation, together with further objects and advantages thereof, may best be understood by reference to the following description, taken in connection with the accompanying drawings, in which:

FIG. 1 is a perspective view of the novel loudspeaker enclosure of the present invention;

FIG. 2 is a longitudinal cross sectional view of the loudspeaker shown in FIG. 1 as taken in the direction of arrows 2—2 thereof;

FIG. 3 is a transverse cross sectional view as taken in the direction of arrows 3—3 of the loudspeaker enclosure shown in FIG. 2; and FIG. 4 is a diagrammatic graph showing the differential area coupler traces of the present invention loudspeaker enclosure as compared to both closed and ported enclosures;

FIG. 5 is a perspective view of another embodiment of the present invention;

FIG. 6 is a transverse cross-sectional view of the enclosure shown in FIG. 5 as taken in the direction of arrows 5—5 thereof;

FIG. 7 is an enlarged cross-sectional view of the loudspeaker enclosure shown in FIG. 5 as taken in the direction of arrows 7—7 thereof; and FIG. 8 is a rear perspective view of the lower speaker arrangement employed in the enclosure shown in FIGS. 5–7 inclusive.

DESCRIPTION OF PREFERRED EMBODIMENT

Referring now to FIG. 1 the novel woofer loudspeaker enclosure of the present invention is illustrated in the general direction of arrow 10 which includes an elongated box or cabinet 11 having an inner baffle of wall 12 separating the interior of the cabinet into a pair of chambers. End wall 15 of the cabinet operably mounts a speaker cone identified by numeral 16 while the inner baffle 12 operably mounts a loudspeaker cone of reduced diameter identified by numeral 17. Wall 18 on its end opposite to the end carrying wall 15 includes and operably mounts a loudspeaker cone 20. The loudspeaker cone 16 may be described as an active loudspeaker of a woofer type which is operated by a suitable amplifier system. The loudspeaker cone 17 is an inner cone of the passive type. The cone 20 is an outer cone of the passive type. A rigid coupling 21 rigidly connects the cone 17 with the cone 20 so that the cones operates in unison.

Referring now in detail to FIG. 2, it can be seen that the active loudspeaker having cone 16 is mounted on wall 15 and that the cone is energized by connecting its motor to an amplifing system via wires 22. The cone of the active loudspeaker includes a mounting ring 23 for securing the loudspeaker to wall 15 and a suitable cloth or grid 24 may cover the opening in the wall mounting the loudspeaker cone 16. The inner passive cone 17 is mounted within an opening on the inner baffle 12 by means of a mounting ring 25. In this manner, acoustic energy from the cone 16 is introduced to the front side of the passive cone 17 for moving the passive cone accordingly. The outer passive cone 20 which is of substantially greater diameter than the inner passive cone 17 is mounted to the wall 18 by a mounting ring 26 and a conventional cloth or grid 27 may cover the opening to the cone 20. The cones are joined together by the rigid coupling 21 so that the cones 17 and 20 will move in unison but displace different amounts of air. Therefore, speaker cones or diaphragms 17 and 20 may be referred to as slave speakers and that the speakers are sealed so that the cones or diaphragms move in unison because of the rigid coupling or connector 21 connected between the two cones or diaphragms of the speakers. Once the active cone 16 of the woofer loudspeaker commences to move, a rear wave of energy is created which drives the passive inner cone 17. This in turn will drive the larger outer passive cone 20 via the rigid connector or coupling 21. Since the volume of air moved by speaker 17 is less than the volume of air moved by the larger speaker cone 20, amplification is provided in the area of lower frequencies and the volume of air being moved is initiated by the energization of the wooferspeaker and cone 16.

The cones are sized such that at very low frequencies the outer passive cone 20 displaces more air than the woofer cone 16. The system can also be made with multiples of the above components. The primary advantage of the inventive system over the prior art is the ability of the invention to reproduce lower frequencies and a much sharper cut-off of frequencies below the operating band width.

Referring now to FIG. 4 in detail, a chart is illustrated indicating maximum flat response for a closed box indicated by graph A, a ported box indicated by B and a differential area coupler indicated by C. The frequency response of the present invention is substantially identical to the differential air coupler indicated by line C which is extremely flat as plotted against normalized amplitude along the vertical and normalized frequency along the horizontal. Therefore, it can be seen that by the use of the present invention, a combination of lower frequency response and high efficiency is gained in a small enclosure or cabinet. A much sharper cut-off is experienced by the use of the present invention at lower frequencies in order to maintain high efficiency.

Referring now in detail to FIG. 5, another embodiment of the present invention is shown incorporating the inventive concept. A loudspeaker enclosure 30 is illustrated having an active speaker 31 which powers or energizes a slaved loudspeaker 32. The active speaker is located in an upper chamber in the enclosure 30 while the slave or output speaker 32 is in the lower portion of the enclosure 30.

Referring now to FIGS. 6 and 7, it can be seen that the active speaker 31 is in an upper chamber of enclosure 30 and is separated from a lower chamber by means of a baffle or barrier 33. The lower chamber houses the output or slave speaker 32. The output speaker 32 also includes a cone 34 which is of smaller diameter than the output cone 32. The cones 32 and 34 are joined together by a fixed rod 35 having a weighted member 36 attached thereto. Therefore, it can be seen that the cone 32 and 34 move in unison when acoustical energy is supplied between the opposing services of the cone via a port 37 interconnecting the upper and lower chambers. To provide suitable movement, speakers 32 and 34 are attached to the cabinet via compliances 38 and 39 respectively. A shroud 40 surrounds the speakers 32 and 34 so that the air between the opposing surfaces of the speaker cones is trapped and responsive to acoustical input via port 37. Therefore, the mounting of the speakers 31 and the output speaker 32 with its attendant speaker 34 create sealed, air tight chambers and that the outer or output loudspeaker cone 32 is passive and is larger in diameter than the inner passive cone 34 so that at very low frequencies, the out passive cone displaces more air than the active speaker cone 31.

As previously described in connection with the embodiment shown in the earlier figures, the cones of speakers 32 and 34 are rigidly coupled together via the weighted element 36 and the connector 35. However, air moved by the active loudspeaker cone 31 is introduced to the opposing backsides of the loudspeaker cones 32 and 34 via port 37 so that the output speaker responds to the acoustical energy transmitted thereto.

As shown in FIG. 8, the output speaker comprising the output speaker cone 32 and the inner speaker cone 34 are produced in a unitary construction along with a surrounding frame identified by numeral 41. The surrounding frame also includes an opening which defines the port 37. A face frame 42 may be employed for attaching the unitary assembly of passive loudspeakers directly to the enclosure 30 by means of screws as shown in FIG. 7.

While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

What is claimed is:

1. A woofer loudspeaker comprising:

an enclosure having opposite end walls arranged in fixed spaced apart relationship;

an inner baffle secured in said enclosure between said opposite end walls defining the interior thereof into a pair of air tight chambers;

an active loudspeaker mounted on a wall of said enclosure and having a cone facing exteriorly of said enclosure so as to produce a back soundwave within a first of said air tight chambers; and passive loudspeaker means mounted on said baffle and a second wall of said walls responsive to said back soundwave produced by said active loudspeaker to produce an amplified soundwave exteriorly of said enclosure.

2. The invention as defined in claim 1 wherein:

said passive loudspeaker means includes a pair of cones arranged in back-to-back relationship in said second air tight chamber so as to operate in unison in response to said active loudspeaker cone.

3. The invention as defined in claim 2 wherein:

said pair of passive loudspeaker cones are circular and of different diameter wherein the smaller cone of said pair couples to the same air chamber as the rear of said active loudspeaker cone and the larger cone faces exteriorly of said enclosure.

4. The invention as defined in claim 3 wherein:

said pair of passive loudspeaker cones are connected by a rigid coupler so as to operate in a differential manner in response to said active loudspeaker cone.

5. The invention as defined in claim 4 wherein:

said smaller cone of said passive loudspeaker means is mounted on said inner baffle and said larger cone of said passive loudspeaker means is mounted on the other of said walls.

6. The invention as defined in claim 5 wherein:

the volume of said air tight chamber between said first end wall carrying said active loudspeaker and said baffle is smaller than the volume of said other air tight chamber between said baffle and said second end wall carrying said passive loudspeaker cone of larger diameter.

7. The invention as defined in claim 6 wherein:

said passive loudspeaker cones are back-to-back and coaxial with said active loudspeaker cone.

8. The invention as defined in claim 7 wherein:

said larger passive loudspeaker cone displaces more air than said active loudspeaker cone.

9. A woofer loudspeaker comprising:

an enclosure having a pair of air tight compartments in fluid communication via an interconnecting passage:

an active loudspeaker mounted in a first compartment of said pair having a cone facing exteriorly of said enclosure so as to produce a back soundwave within said first compartment; and passive loudspeaker means including a pair of back-to-back cones mounted in said other compartment of said pair so as to operate in unison in response to said back soundwave via said interconnecting passage.

10. The invention as defined in claim 9 wherein:

said passive loudspeaker means is mounted on a frame detachably carried on said enclosure;

a collar supporting the edge marginal region of a selected one of said cones of said pair and having an opening therein separating said pair of cones and being co-extensive with said interconnecting passage.

11. The invention as defined in claim 10 wherein:

said non-selected cone of said pair of cones is attached by its outer edge marginal region to said frame and attached at its inner edge marginal region to the backside of said selected cone.

12. The invention as defined in claim 11 including:

a weighted element secured to the center of said selected cone.

* * * * *